US007275291B2

(12) United States Patent
Josefsson

(10) Patent No.: US 7,275,291 B2
(45) Date of Patent: Oct. 2, 2007

(54) PNEUMATIC THREAD STRETCHER AND THREAD PROCESSING SYSTEM

(75) Inventor: Paer Josefsson, Boras (SE)

(73) Assignee: IROPA AG, Baar (CH)

( * ) Notice: Subject to any disclaimer, the term of this patent is extended or adjusted under 35 U.S.C. 154(b) by 260 days.

(21) Appl. No.: 10/507,184

(22) PCT Filed: Jul. 17, 2002

(86) PCT No.: PCT/EP02/07971

§ 371 (c)(1),
(2), (4) Date: Apr. 25, 2005

(87) PCT Pub. No.: WO03/076704

PCT Pub. Date: Sep. 18, 2003

(65) Prior Publication Data

US 2005/0217094 A1 Oct. 6, 2005

(30) Foreign Application Priority Data

Mar. 12, 2002 (SE) ..... 0200745

(51) Int. Cl.
*D02J 1/22* (2006.01)
*D02H 13/22* (2006.01)

(52) U.S. Cl. ..... 28/240; 28/172.2

(58) Field of Classification Search ..... 28/240, 28/241, 242, 172.2, 271, 272–276, 243, 203.1, 28/254, 283; 66/146, 125 R; 112/DIG. 3; 242/147 A; 139/450, 435.1, 435.2, 435.4, 139/435.5, 435.6, 194

See application file for complete search history.

(56) References Cited

U.S. PATENT DOCUMENTS

| | | | | | |
|---|---|---|---|---|---|
| 2,302,790 | A | * | 11/1942 | Modigliani | 28/283 |
| 2,333,267 | A | * | 11/1943 | Modigliani | 28/240 |
| 3,944,166 | A | * | 3/1976 | Hermanns | 242/147 A |
| 3,999,909 | A | * | 12/1976 | Schippers | 28/240 |
| 4,119,253 | A | * | 10/1978 | Benson | 226/7 |
| 4,217,323 | A | * | 8/1980 | Foster et al. | 28/240 |
| 4,637,229 | A | | 1/1987 | Taylor, Jr. | |
| 4,790,150 | A | * | 12/1988 | Stoll | 66/125 R |
| 5,351,373 | A | * | 10/1994 | Ryan | 28/240 |
| 5,816,296 | A | | 10/1998 | Schuster | |
| 6,009,915 | A | * | 1/2000 | Schaich et al. | 139/28 |
| 6,263,882 | B1 | * | 7/2001 | Chehab et al. | 28/240 |
| 6,421,891 | B2 | | 7/2002 | Bartkowiak et al. | |
| 2003/0033699 | A1 | * | 2/2003 | Ficker | 28/240 |

FOREIGN PATENT DOCUMENTS

| | | |
|---|---|---|
| GB | 1 469 533 | 4/1977 |
| JP | 1-314762 | 12/1989 |
| JP | 5-209343 | 8/1993 |
| WO | WO 00/15532 | 3/2000 |

* cited by examiner

*Primary Examiner*—Amy B. Vanatta
(74) *Attorney, Agent, or Firm*—Flynn, Thiel, Boutell & Tanis, P.C.

(57) ABSTRACT

The invention relates to a pneumatic thread stretcher (T) for a rapier weaving machine or a knitting machine, in which the air current deflection surface (19) for deflecting the thread (Y, Y1) forms a seamless extension (12) of the inner wall of the linear guide channel, through which the thread runs. The invention also relates to a device (H) for changing the flow rate or the pressure of the air current along the deflection surface (19) of the pneumatic thread stretcher (T) between at least two different levels, in accordance with the operating cycle o the textile machine.

8 Claims, 1 Drawing Sheet

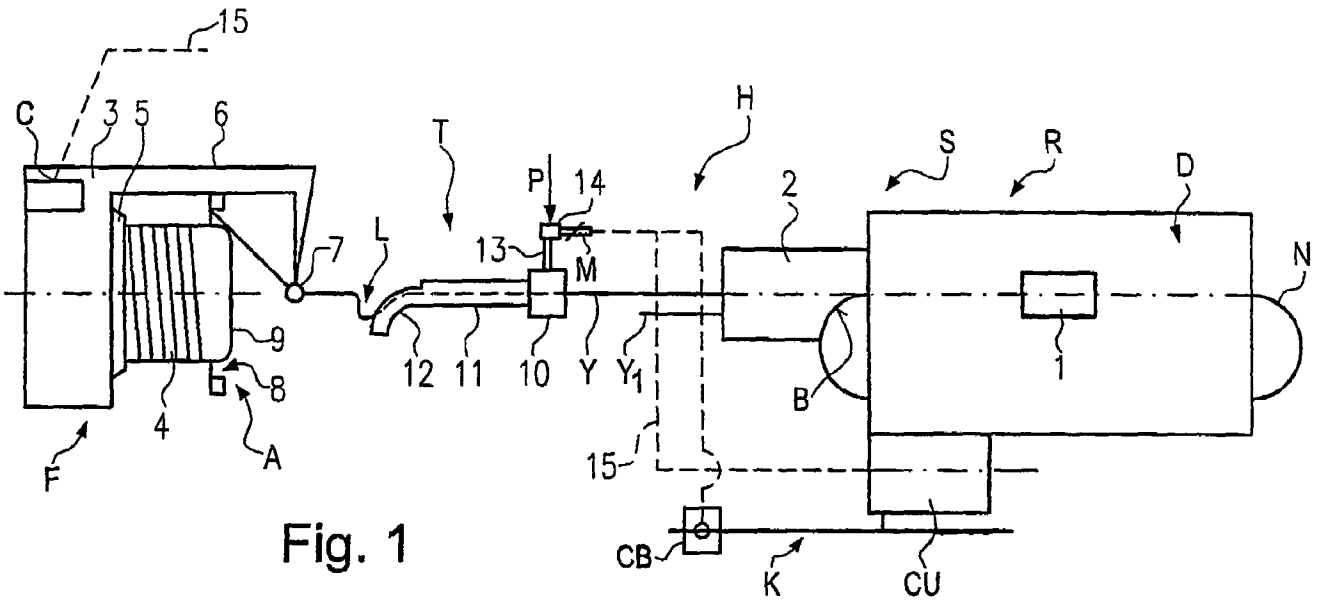
Fig. 1
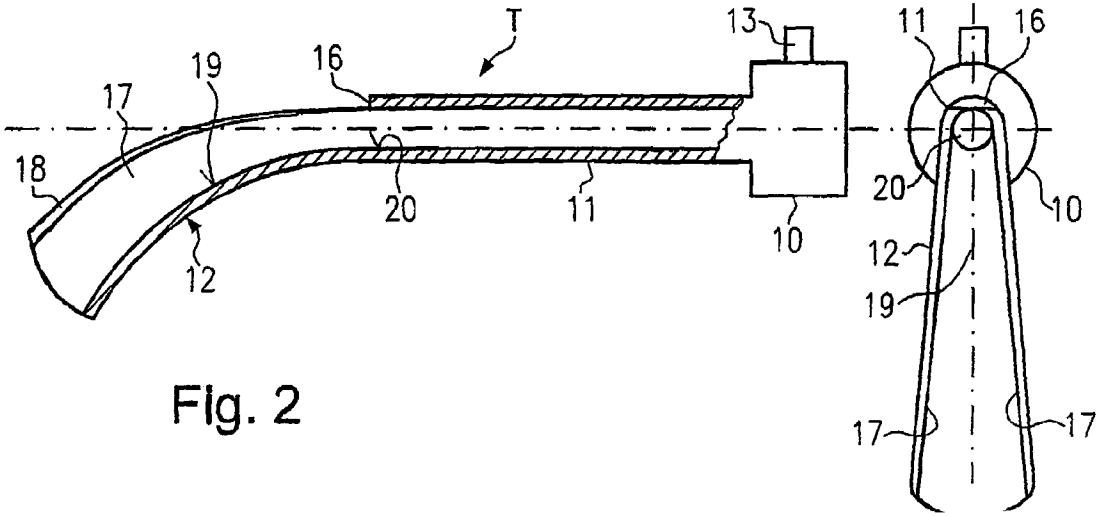
Fig. 2
Fig. 3

PNEUMATIC THREAD STRETCHER AND THREAD PROCESSING SYSTEM

The invention relates to a pneumatic thread stretcher according to the preamble of claim 1 and to a thread processing system according to the preamble of claim 7.

In the thread processing system according to GB 14 6 9533 A the pneumatic thread stretcher is arranged downstream of a yarn feeding device operating with slip feed and upstream of a knitting system of a flat knitting machine, such that the air current exiting from the blow-out end of the tube body is opposite to the thread running direction. A cylinder is arranged with considerable distance in front of the blow-out end of the tube body, the cylinder having a cylinder axis oriented lateral to the thread running direction. A prolongation of the axis of the tube body is substantially tangential to the periphery of the cylinder. The air current exiting along the thread from the blow-out end is deflected at the outer periphery of the cylinder away from the prolongation of the tube body axis such that it forms a stretching loop in the thread. The flow rate and the pressure of the air current can be adjusted. The pneumatic thread stretcher operates continuously. The thread stretcher even is for use in a thread processing system including a weaving machine. The continuous operation of the pneumatic thread stretcher results in high air consumption, not only because of the air current which is sidewardly expanded on the cylinder periphery, and the thread may be damaged in a rest period by the flow dynamic of the air current. Furthermore, the permanent danger exists that the air current exiting from the blow-out end escapes in front of the cylinder through the intermediate space between the blow-out end and the cylinder such that the thread might form a false loop in this intermediate space which loop might become entangled easily or deviated sidewardly on the cylinder periphery such that the thread might be ruptured when the textile machine again exerts tension to stretch the thread.

The thread processing system known from U.S. Pat. No. 5,816,296 A includes a weaving machine and is provided with a tubular structure in the thread running path which structure is penetrated by the thread. Two nozzles are provided within the tubular structure one of which is blowing counter to and the other in running direction. Both nozzles are actuated and/or separated from the pressure supply via magnet valves depending on the operation cycle of the weaving machine.

The pneumatic thread stretcher according to U.S. Pat. No. 6,009,915 A is operating with two nozzles which are oriented in relation to each other with an acute angle in order to stretch a slack thread by forming a loop.

It is an object of the invention to provide a pneumatic thread stretcher of the kind as mentioned above which is structurally simple and effectively stretches the thread, which operates with relatively low air consumption and does not produce a danger for the thread. Furthermore, it is an object of the invention to provide a thread processing system including at least one pneumatic thread stretcher within which thread processing system the thread stretcher is operating with relatively low air consumption and does not produce danger for the thread.

These objects are achieved according to the invention by the features of claim 1 and by the features of claim 7, respectively.

As the air current deflection surface in the thread stretcher is formed as a seamless and sidewardly limited prolongation of the inner wall of the guiding channel, substantially the entire energy of the air current can be used for stretching the thread. Parts of the air current are not allowed to disappear unused sidewardly in front of the deflection surface. A relatively laminar flow or current is generated which optimally uses the Coanda effect, i.e. adheres to the deflection surface such that it pulls the thread from the axis of the tube body sidewardly into the loop in order to stretch the thread, provided that the thread is able to yield at this point in time. The sideward limitations of the deflection surface avoid losses of pressurised air and act to provide an effective and defined control of the thread during the formation of a loop.

By changing the flow rate or the pressure of the air current along the deflection surface between at least two different levels and in association with the operation cycle of the textile machine not only the air consumption is reduced in the yarn processing system, but, overall, in resting periods of the thread, the danger of damage to the thread by the flow dynamic of the air current is minimised. When the low level is applied the mechanical load for the thread is uncritical. The high level is applied then in association with the operation cycle of the textile machine, and only temporarily when an additional effect of the pneumatic yarn stretcher is needed for a proper thread run control.

In a structurally simply fashion the air current deflection surface is formed unitarily with the tube body in the thread stretcher. A separate holder for the deflection surface is not needed then. The prolongation expediently is formed like a half pipe which is limited on both sides by guiding walls such that the air current is properly guided as soon as it follows the deflection surface, and that the thread is formed in a controlled fashion into the stretching loop.

The side walls may either diverge or converge or extend parallel to each other, respectively, exiting from the air current deflection surface. The side walls should be distant from each other so that the thread does not contact the side walls during a stretched or normal thread run.

The prolongation may be formed from an excess length of the tube body. The excess length is cut open in longitudinal direction such that the tube walls may be bent outwardly or opened, respectively, and such that the entire excess length can be bent away to one side of the axis of the tube body. This is simple to manufacture.

An adjusting member is provided within the communication with the pressure supply of the yarn thread stretcher. The adjusting member allows to change the flow rate or the pressure, respectively, of the air current or flow which is generated along the deflection surface, between at least two different adjustment values, expediently remotely controlled such that the thread stretcher only then produces a significant stretching effect in the thread when this effect is needed for the thread run control. During phases which do not need a stretching effect, e.g. during a rest period of the thread, it is operated at the low level at which the air current is sufficiently weak and does not have a damaging effect on the thread. In the case that it would be blown with an unchanged flow rate or unchanged pressure in the rest period of the thread, it could not be avoided that the thread would dance in the current and would be opened by the current or even would contact the tube body or the deflection surface in beating fashion such that it could be damaged.

In the thread processing system and within the communication between the thread stretcher and pressurised air supply at least one adjustment member is provided which contains an electric adjustment drive. Expediently this is a magnet valve which can be switched between at least two different levels of the flow rate or the pressure, respectively. The operation of the thread stretcher, in this fashion, may be controlled in dependence from the operation cycle of the textile machine. The signals effecting the switchover between the levels are transmitted via a signal connection, in particular either from a control device of the textile machine or of the thread feeding device, or from a communication system into which the textile machine and/or the thread feeding device is or are incorporated. In the case of a communication system, e.g. of a data bus system (CAN or the like), very often a control box is provided by which different function units are controlled or monitored. The signals for actuating the adjustment drive of the thread stretcher expediently could be derived from this control box, e.g. by means of a processor capable of interpreting messages.

In case that a product is made in the textile machine which product has a pattern, e.g. in a weaving machine consuming weft threads of different qualities or colours within several thread channels, or within a knitting machine including several knitting systems, it may be expedient to design the assembly such that it switches the thread stretcher between the levels depending on the pattern. This means that, e.g., only the thread stretcher of an activated thread channel is operating on the high flow rate level or pressure level, while the thread stretchers within the not activated thread channels are kept passive or operate on the low level only. The thread stretcher of an activated thread channel then even may be switched between the high and low levels by the assembly in adaptation to the operation cycle of the textile machine within this thread channel. The high level is selected e.g. then when it is to be prevented by an additional thread stretching effect that the thread temporarily might relax too much, or to assist a component of the textile machine by increased yarn tension which component preliminarily needs a stronger tension in the thread for a proper function, respectively.

The assembly may designed in a thread processing system having a rapier weaving machine such that the strong flow rate or the high pressure is temporarily selected in the thread stretcher during an insertion cycle when the bringer gripper takes over the thread tip and/or transfers the thread tip to the taker gripper, and/or when the insertion process is terminated. During the other phases of the insertion process, to the contrary, the low level is selected, because at these times already a significant tension will be present in the thread. The switching action is carried out by the assembly by means of signals correlated to pre-defined rotational angles or rotational angle ranges of the main shaft of the rapier weaving machine during the above-mentioned operation phases.

In a yarn processing system including a rapier weaving machine and several yarn channels which are activated alternatingly depending on the weaving pattern a pneumatic thread stretcher is provided in each thread channel. The assembly is designed such that it adjusts the flow rate or the pressure just then to the lower level when the thread channel containing this thread stretcher is not activated and when the thread, e.g. during a rest period, has stopped. This is carried out, preferably, by means of signals, e.g. derived from the control of a thread selector, which signals represent the then at least one de-activated thread channel.

Optimal results can be achieved when the controlled pneumatic thread stretcher located in the thread run path downstream of the thread feeding device is functionally combined with a stationary thread braking ring, preferably with a soft bristle brake ring, which contacts a withdrawal end of a stationary storage drum in the thread feeding device. This bristle brake ring produces a relatively constant basic thread tension which is superimposed by an additional tension load by the thread stretcher, which addition tension load is not significant at the low level, or does not exist even then, but is significant at the high level. The bristle brake ring, furthermore, prevents that, in some cases, the thread may relax upstream of the formed loop back to the storage drum which might disturb the other thread windings which already are prepared on the storage drum.

Embodiments of the invention will be explained with the help of the drawing. In the drawing is:

FIG. 1 a schematic total illustration of a thread processing system, with several detail variants indicated in the figure, FIG. 2 a partial longitudinal section of a pneumatic thread stretcher, and FIG. 3 a view of the thread stretcher of FIG. 2 from the left side.

A thread processing system S in FIG. 1 includes among others a textile machine R, e.g. a rapier weaving machine or even a knitting machine, at least one thread feeding device F, and a pneumatic and controlled thread stretcher T in the thread running path downstream of the thread feeding device.

The textile machine R which is explained for an example of a rapier weaving machine, comprises a weaving shed D and driven bringer and taker grippers B, N for inserting at least one thread Y, Y1 from at least one thread channel. The bringer gripper B takes the tip of the thread within an insertion and selector device 2 and pulls the thread to the middle of the weaving shed D where it transfers the tip of the thread in a region 1 to the taker gripper N. The taker gripper then pulls the thread entirely through the weaving shed and terminates the insertion process.

The thread feeding device F has a housing 3 and a stationary storage drum 4 to which the thread Y is applied in successive windings by means of a winding element 5. A withdrawal eyelet 7 is positioned at a housing bracket 6. Furthermore, a thread brake A in the form of a, preferably soft, bristle brake ring 8 is fixed at the housing bracket 6. The thread brake A contacts a withdrawal end 9 of the storage drum 4 from the outside and opposite to the withdrawal direction of the thread.

The pneumatic thread stretcher T comprises a housing 10 and a tube body 11 extending in the direction of the thread running path. The tube body 11 has a sidewardly curved and bent away prolongation 12 at the side opposite to the thread running direction. The detailed structure of the thread stretcher T will be explained later with the help of FIGS. 2 and 3. A port 13 is provided at the housing 10 which port is connected or connectable with a pressure supply P for pressurised air. An assembly including an adjusting member 14 for the flow rate or the pressure, e.g. including a magnet valve having an electric adjusting drive M (e.g. a switching magnet or a proportional magnet) serves to switch the flow rate or the pressure, respectively, between at least two different values. The switchover is carried out remotely controlled by the assembly A and by signals which arrive via a signal connection 15 either from a control device C of the thread feeding device or from a control device CU of the textile machine R or from a communication system K, respectively. In the case of a communication system K into which the thread feeding device F and the textile machine R are integrated, a central control box CB may be provided within which out of messages sent in the communication system K (e.g. a CAN-bus system) the signals for the adjustment drive M are generated. The high and low levels are adjustable nominally. The low level expediently selected such that the thread is hardly loaded or is not loaded at all. The high level is adjusted such that the thread undergoes an expedient tension load by an air current and is deflected along the prolongation 12 from the straight thread path into a sideward loop L while it is stretched from the downstream side of the thread path.

In the case of a rapier weaving machine it is expedient to select the high flow rate or pressure level temporarily exactly then, e.g. depending on the detected rotational angle of the main shaft of the rapier weaving machine, when the bringer gripper B takes the tip of the thread and/or as soon as the bringer gripper transfers the tip of the thread to the taker gripper N, and/or, finally, at the end of the insertion process. In-between the thread stretcher T is operating at the low level.

When, as is frequently the case, the rapier weaving machine R is alternatingly consuming thread from several thread channels (thread Y, Y1), a respective pneumatic thread stretcher T is associated to each thread channel. Additionally, the assembly H which is responsible for the control of the thread stretchers T is designed such that it adjusts the thread stretcher of a not activated thread channel to the low flow rate or pressure level. The thread assembly H may be commonly associated to all thread stretchers, or a respective assembly H is provided for each thread stretcher, respectively.

In analogous fashion a knitting machine is equipped in its thread channels with pneumatic thread stretchers T of the kind as shown here, and will then be provided with an assembly H for controlling the thread stretchers depending on the operation cycle of the knitting machine between different flow rate levels and pressure levels.

According to FIG. 2 the straight tube body 11 defines an air current guiding channel and also a thread guiding channel 20. The air current is produced with pressurised air from the port 13 opposite to the thread running direction by a nozzle assembly which is not shown in detail and is contained in the housing 10. The prolongation 12 forms an air current deflection surface 19 which is bent sidewardly and convexly away from the theoretical extension of the axis of the tube body. The air current deflection surface 19 is limited at both sides by guiding walls 17. This design is simply realised e.g. in that the tube body 11 is manufactured with an excess length which corresponds in length to the prolongation 12. Then this excess length is longitudinally cut open up to a shoulder 16. Then the remaining tube walls are bent outwardly to form the guiding walls 17. Then the prolongation 12 is brought into the curved shape. The inner edges of the guiding walls 17 may have inside chamfers 18 or may be rounded in order not to endanger the thread. The guiding walls 17 of the basically U-shaped prolongation may, starting from the deflection surface 19, diverge or converge or may extend in parallel. The thread stretcher T functions with the so-called Conanda effect. This means that the relatively laminar air current which is directed along the guiding channel 20 adheres to the deflection surface 19 and follows the deflection surface 19 and deforms the thread (as indicated in FIG. 1) into the loop L and by that stretches the thread provided that the thread at this moment has a low thread tension. In FIG. 3 it is indicated that the distance between the guiding walls 17 is gradually increasing.

Alternatively, the tube body 11 with the prolongation 12 also may be a plastic form part, e.g. an injection moulded part.

The adjusting member 14 for the flow rate and the pressure as shown in FIG. 1 expediently is a quick responding pneumatic magnet valve. The nozzle assembly in the housing 10 expediently is a so-called ejector nozzle which directs in FIGS. 1 and 2 the air current to the left side and, at the same time, also sucks in air from the right end of housing 10. In the thread path downstream of the thread stretcher further devices may be provided which monitor or control the thread run, as is conventional for rapier weaving machines.

The invention claimed is:

1. Pneumatic thread stretcher, in particular for a rapier weaving machine or a knitting machine, comprising a substantially straight tube body having one end communicating with a pressurized air supply and remote from the one end having a blow-out end which defines a thread guiding channel and air current guiding channel, and an air current deflection surface arranged in front of the blow-out end substantially in the vicinity of a theoretical extension of the axis of the tube body, the air current deflection surface being bent in a blowing direction from the blow-out end in curved fashion away from the axis of the tube body, wherein the air current deflection surface is a seamless, sidewardly limited prolongation of an inner wall of the guiding channel.

2. Pneumatic thread stretcher as in claim 1, wherein the air current deflection surface is integrally formed with the tube body.

3. Pneumatic thread stretcher as in claim 1, wherein the air current deflection surface is arranged in the prolongation as a half pipe limited at both sides by guiding walls.

4. Pneumatic thread stretcher as in claim 1, wherein the cross-section of the prolongation is substantially U-shaped including side walls which, starting from the air current deflection surface, diverge or converge or extend in parallel.

5. Pneumatic thread stretcher as in claim 1, wherein the prolongation is formed from an excess length of the tube body by cutting open and bending the tube walls outwardly and bending away the excess length to one side of the axis of the tube body.

6. Pneumatic thread stretcher as in claim 1, wherein in the communication with the pressurized air supply at least one adjustment member is contained by which the flow rate or the pressure of an air current produced along the air current deflection surface is adjustable and/or switchable between at least two different values.

7. Pneumatic thread stretcher as in claim 6, wherein the adjustment member is remotely controlled.

8. Pneumatic thread stretcher as in claim 1, wherein the air current deflection surface is defined by a U-shaped portion of the prolongation of the guiding channel.

* * * * *